US005266935A

United States Patent [19]

Wahlert

[11] Patent Number: 5,266,935

[45] Date of Patent: Nov. 30, 1993

[54] PIXEL DISPLAY ASSEMBLY

[75] Inventor: Ralph L. Wahlert, Port Jefferson Station, N.Y.

[73] Assignee: The Staver Company, Inc., Bay Shore, N.Y.

[21] Appl. No.: 833,134

[22] Filed: Feb. 10, 1992

[51] Int. Cl.[5] ..... G09G 3/34

[52] U.S. Cl. ..... 345/84; 40/449; 345/111

[58] Field of Search ..... 340/783, 764, 763, 815.05, 340/815.07, 815.27, 815.29, 815.31; 40/492, 582, 531

[56] References Cited

U.S. PATENT DOCUMENTS

| | | | |
|---|---|---|---|
| 3,916,403 | 10/1975 | Mandzsu et al. | 340/763 |
| 4,163,332 | 8/1979 | Salam | 340/783 |
| 4,794,391 | 12/1988 | Costa et al. | 340/764 |
| 4,983,956 | 1/1991 | Salam | 340/815.27 |
| 5,021,773 | 6/1991 | Browne | 340/783 |
| 5,055,832 | 10/1991 | Browne | 340/783 |
| 5,148,156 | 9/1992 | Huber et al. | 34/783 |

*Primary Examiner*—Ulysses Weldon
*Assistant Examiner*—Doon Yue Chow
*Attorney, Agent, or Firm*—Edward H. Loveman

[57] ABSTRACT

A pictorial element display assembly adapted for mounting in a matrix of similar assemblies to present a character by transmitted and/or reflected light. The assembly has a rectangular opaque panel formed with a pocket defining a window in which is set a colored plate for displaying the illuminated pixel. A pair of light spot projecting caps set in keyhole shaped slots in the colored plate have parallel, coplanar axes aligned on a central axis midway between lateral edges of the panel. A D-shaped gate is rotatable through 180° by an electromagnetic device, to open and closed positions on the window and on the panel for selectively uncovering and covering the covered plate. The caps engage ends of light transmitting fiber cords which carry light from a light source to project the light as light spots in intense beams out of central holes in ends of the caps. The axis of rotation of the gate is parallel to and spaced laterally from the central axis of the colored plate, away from the colored plate.

10 Claims, 3 Drawing Sheets

PIXEL DISPLAY ASSEMBLY

BACKGROUND OF THE INVENTION

1. Field of the Invention

This invention relates to the art of pictorial element display devices and more particularly it concerns an assembly adapted for displaying a portion of graphic character by transmitted and/or reflected light, such character being numerical, alphabetical or pictorial.

2. Description of the Prior Art

Pictorial element or pixel display devices are generally arranged in matrices for day and night viewing, such as described in U.S. Pat. No. 4,983,956 and British Patent 2,045,991 A, which are typical of the prior art. One known pixel display device employs a panel formed with a window through which a pixel or portion of a graphic character can be viewed by transmitted and/or reflected light. A rotatable opaque gate can alternately cover the window or open the window to expose the pixel. This type of display device also has means for projecting a light spot to enable a viewer to perceive the pixel being projected in a matrix of pixels. This prior display device has a number of drawbacks. For examples, the light spot is located in such a way that there is a gap between the pixel and light spot so that each time the window is opened, objectional jitter of vibration of the pixel seems to occur. Another objection is the lack of intensity of the light spot so that it is often not easily visible by day under hazy and foggy conditions.

SUMMARY OF THE INVENTION

The present invention has a principal object to provide a pixel display apparatus which provides an improved display while avoiding the objections and disadvantages of the prior pixel display devices. According to the invention there is provided a pixel display assembly which can be made part of a matrix of similar assemblies to depict an entire character or group of characters. The assembly has a rectangular panel formed with a window in which is a colored plate. In the plate are two slots retaining two optical projecting caps. Each cap can be fitted with a lens, and an optical fiber light transmission cord can be inserted and terminated in the cap. Each fiber cord can be connected to a light source behind the display panel for generating an intense light spot at the window. The window plate can be transparent, translucent or opaque. If it is inserted in an opening in the panel for viewing by reflected light it should be translucent or opaque. If the pixel is only to be viewed by transmitted light, the window plate should be transparent. If the pixel is to be viewed only by optical fibers the window plate should be opaque. The optical fiber cords and light spot projecting caps have coplanar, parallel optical axes which are located precisely on a central line midway between opposite lateral edges of the display panel. Offset laterally away from the window plate and the central axis of rotation of the D-shaped gate turnable through 180° between open and closed positions. The gate is turnable by electromagnetic means such as described in U.S. Pat. No. 4,393,362. In the open position of the gate the colored window of the display assembly and the light spots are fully exposed. In the closed position of the gate, the light spots at the window plates are covered and the window plate is concealed.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENTS

Figure 1:
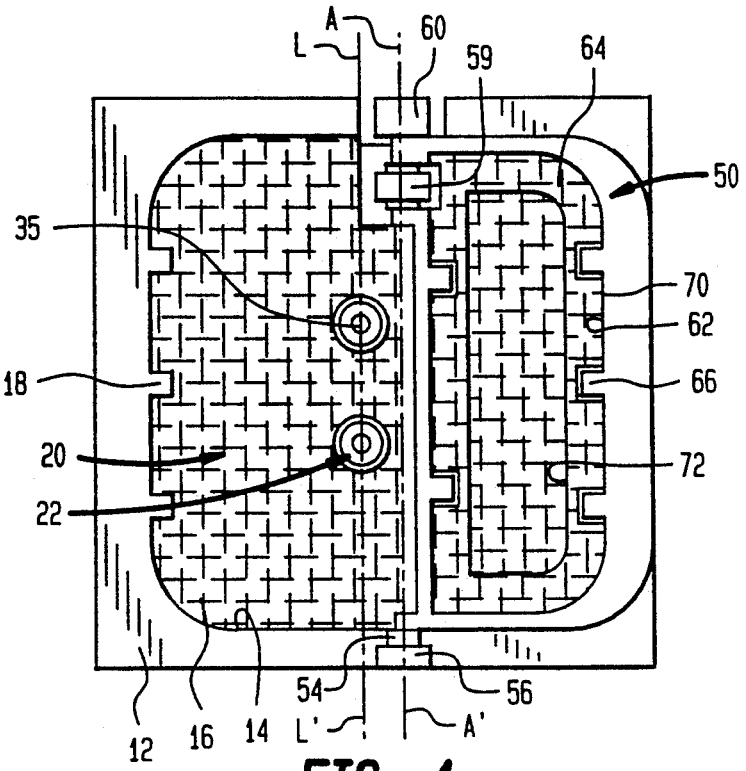
FIG. 1 is a front elevational view of a pixel display assembly embodying the invention shown with window fully open and gate turned to open position.
Figure 2:
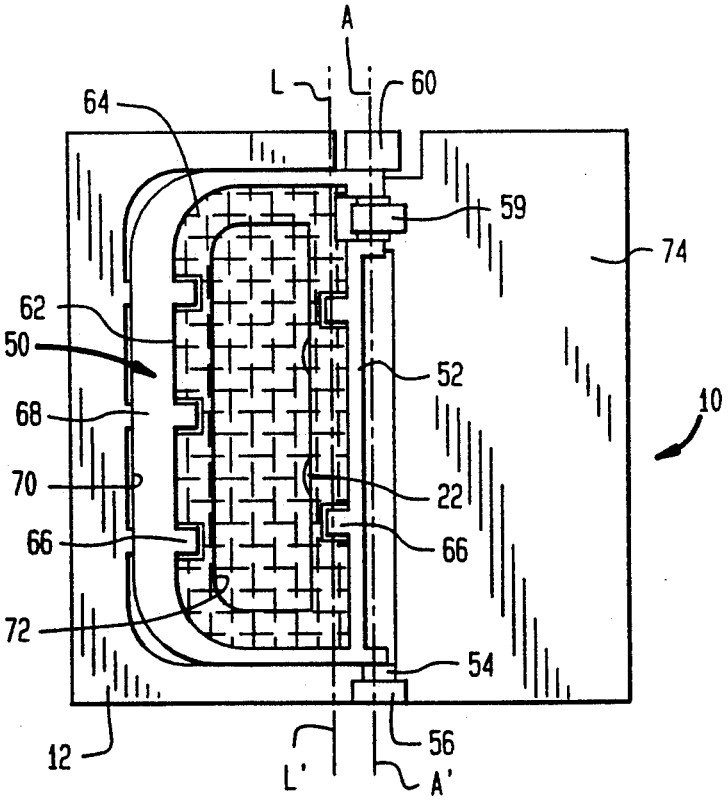
FIG. 2 is a front elevational view of the assembly of FIG. 1 with gate shown in closed position.
Figure 3:
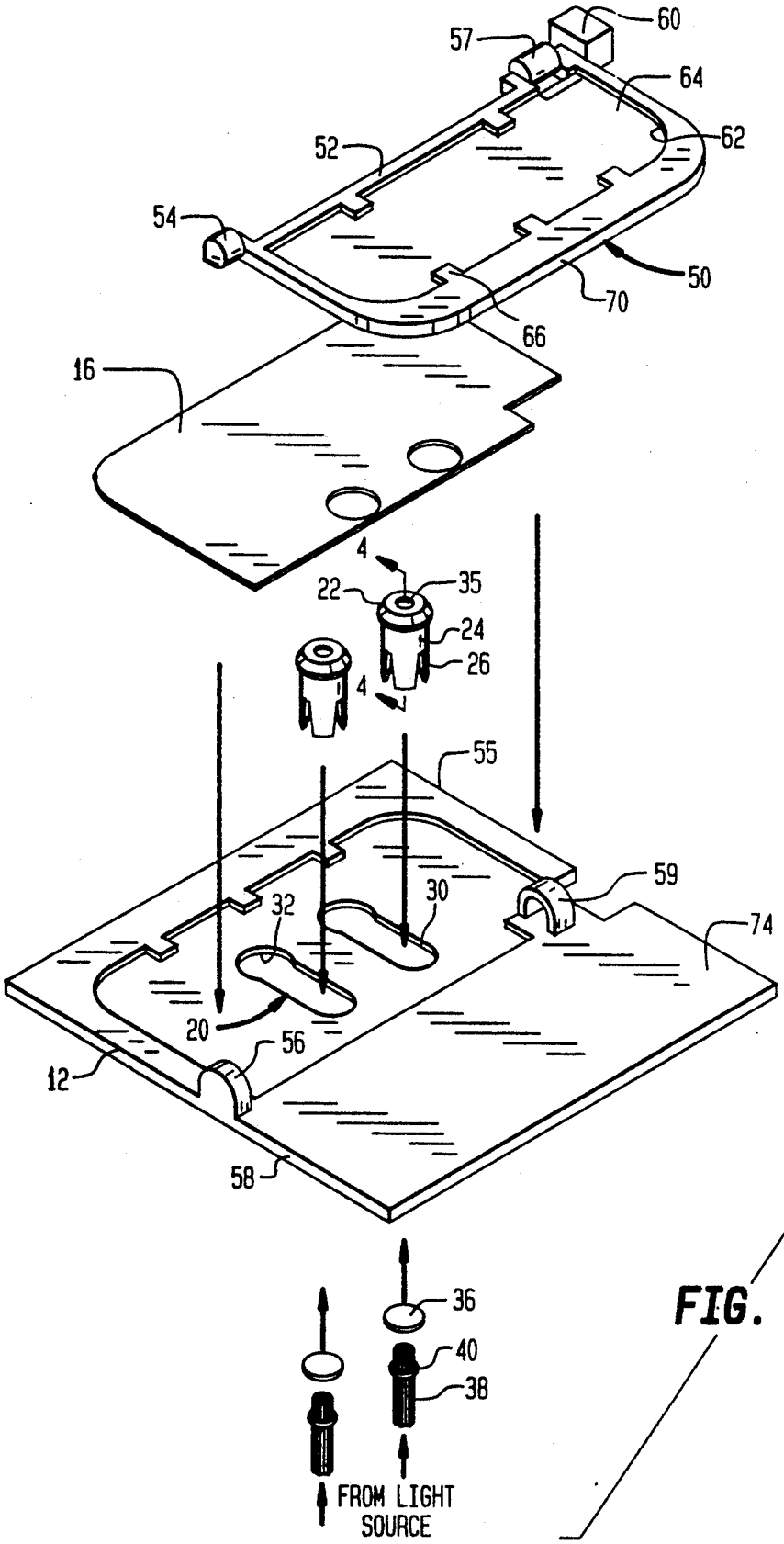
FIG. 3 is an exploded isometric view of components of the pixel display assembly of FIGS. 1 and 2.
Figure 5:
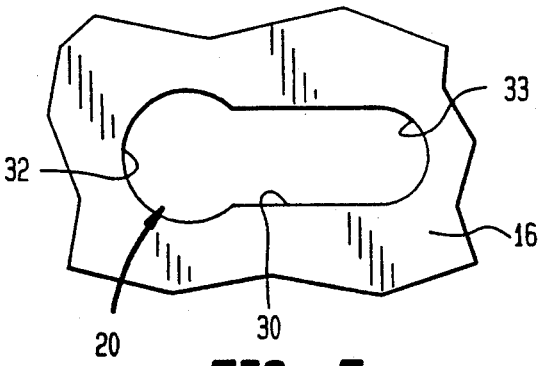
FIG. 5 is a plan view of a keyhole shaped slot in a display window for receiving a light spot projecting cap.
Figure 6:
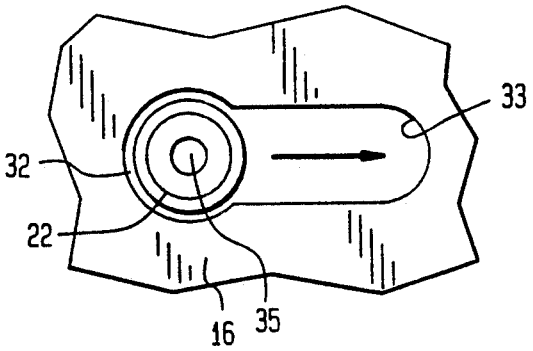
FIG. 6 is a plan view similar to FIG. 5, showing a light spot projecting cap partially in place in a keyhole slot.
Figure 7:
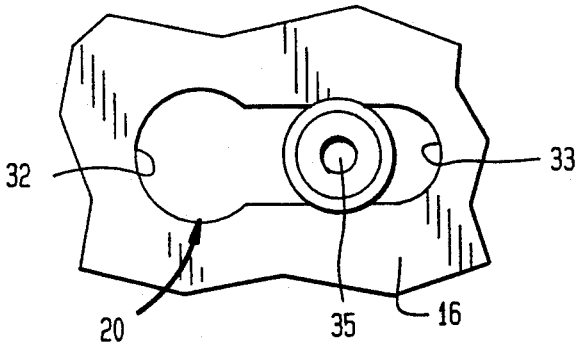
FIG. 7 is a plan view similar to FIGS. 6 and 7, showing the light spot projecting cap fully inserted in place in the keyhole slot.
Figure 4:
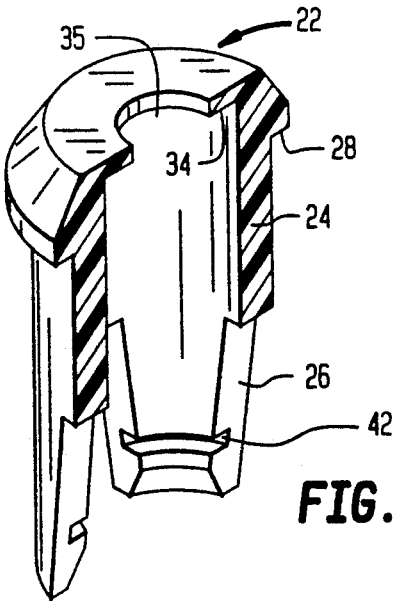
FIG. 4 is an enlarged axial sectional view of a light spot projecting cap, taken on line 4—4 of FIG. 3.

Referring now to the drawings wherein like reference characters designate like or corresponding parts throughout, there is illustrated in FIGS. 1 and 2, a pixel display assembly generally designated by reference numeral 10 which has an opaque black rectangular panel 12 with a generally rectangular pocket opening 14 which receives a correspondingly shaped yellow colored plate 16. The plate 16 is held in place by clips 18. Two transverse keyhole shaped slots 20 are formed in plate 16. These slots receive two light spot projection caps 22. As best shown in FIGS. 3 and 4, each cap has a tapered cylindrical body 24 formed with four flexible legs 26. The body 24 has an annular lip 28 which engages on the narrow, straight edges 30 of the slot 20. The keyhole shape of the slot 20 in the window 16 is best shown in FIGS. 5, 6 and 7. Initially the cap 22 is inserted into the larger round end portion 32 of the slot 20 as shown in FIG. 6, and then the cap is moved laterally toward an a narrower round end 33 to engage and lock in the closely spaced edges 30 of the slot 20 as shown in FIG. 7. Each cap 22 has an inside annular lip or flange 34 with a central hole 35; see FIG. 4. The lip 34 retains a lens 36, shown in FIG. 3, when inserted into the body 24. A light transmitting cord 38 made of optical fibers can be inserted into the cap 22 and secured there by engagement of a bead 40 in an arcuate slots 42 in the legs 26 of the cap 22.

In order to open and close the window 16, there is provided a rotatable D-shaped gate 50, shown in FIGS. 1, 2 and 3, which has a straight back 52 at one end of which is a pintle 54 which engages in a socket 56 at an edge 58 of the panel 12. At another end 55 of the panel 12 is a socket 59 which receives a cylindrical magnetic member 57 axially aligned with a permanent magnet 60, and used in turning the gate 50 through 180° between open and closed positions. The gate 50 rotates on an axis A–A′ which is laterally offset from the central medial line or axis L–L′ on which the optical axes of the light spot projecting caps 22 are disposed; see FIG. 1. Inserted in a D-shaped pocket 62 in the gate 50 is an opaque yellow colored D-shaped frame 64 which is held in place by clips 66. The back portion 68 of the gate 50 is black as is an external edge 70. The pocket 62 in the frame 64 serves to lighten the mass of the structure to facilitate turning of the gate 50 between the open position shown in FIG. 1 where the gate 50 abuts a panel portion 74 of the panel 12 and the closed position, shown in FIG. 2, where the gates abuts and covers the window plates 16.

In operation of the pixel display assembly 10, the gate 50 is turned electromagnetically to the open position shown in FIG. 1 abutting the panel section 74. The holes 35 in the caps 22 are clear and can project intense light beams visible as spots when light from a remote light source is passed through the fiber optical cords 38. A back light source (not shown) can be located behind the window plate 16 to produce a pixel display thereat by transmitted light. In addition or alternatively, the colored window plate 16 can be illuminated by ambient light to reflect a yellow pixel. The gate 50 is shown in closed position in FIG. 2, and rotated 180° from the position of FIG. 1. Rotation is performed electromagnetically by control impulses applied to magnetic circuitry (not shown) behind the panel 12. The gate 50 with the magnet 60 is caused to turn electromagnetically until the gate 50 overlays and abuts the window plate 16. Here the window plate 16 is largely concealed. Since the light spots emitted by the caps 22 are precisely located on the central axis of the assembly panel 12, there will be no apparent shift of the light reflected from the window plate 16, or transmitted therethrough. The gate 50 can be turned periodically or at irregular intervals in response to control pulses applied to the electromagnetic circuitry.

It should be understood that the foregoing relates to only a limited number of preferred embodiments of the invention which have been by way of example only, and that it is intended to cover all changes and modifications of the examples of the invention herein chosen for the purposes of the disclosure, which do not constitute departures from the spirit and scope of the invention.

What is claimed is:

1. A pixel display assembly for mounting in a matrix of similar display assemblies for presenting a character by transmitted and/or reflected light, comprising:

a rectangular, opaque panels having a large, generally rectangular pocket;

a colored plate fitted in said pocket to define a window for displaying a pixel illuminated by light reflected from said window or transmitted through said window;

a pair of light spot projecting caps set in said plate with parallel optical axis disposed in coplanar alignment on a central axis midway between opposite lateral edges of said panel; and a gate, abutting said panel and laterally displaced from said window, said gate being rotatable through 180° on an axis laterally displaced from said central axis to open and closed positions on said window and on said panel respectively for selectively uncovering and covering said colored plate.

2. The pixel display assembly as claimed in claim 1, further comprising electromagnetic means on said panel and said gate and arranged to rotate said gate on said axis of rotation in response to control pulses applied to said electromagnetic means.

3. The pixel display assembly as claimed in claim 2, further comprising bearing means on said panel arranged to support said gate during rotation.

4. The pixel display assembly as claimed in claim 3, wherein said colored plate has a pair of transverse keyhole shaped slots, said light projecting caps being set in said slots for emitting said light spots in intense parallel beams.

5. The pixel display assembly as claimed in claim 4, wherein said caps have central light emitting holes in exposed ends of said caps; and further comprising light transmitting fiber cords having ends set in said caps adjacent to said holes for emitting said intense light beams therethrough and for generating said light spots within margins of said colored plate.

6. The pixel display assembly as claimed in claim 5, wherein said gate is generally D-shaped and has an elongated aperture to lighten the mass of said gate, and to cover said holes in said caps in closed positions of said gate.

7. The pixel display assembly as claimed in claim 3, wherein said caps have central light emitting holes in exposed ends of said caps; and further comprising light transmitting fiber cords having set in said caps adjacent to said holes for emitting said intense light beams therethrough and for generating said light spots within margins of said colored plate.

8. The pixel display assembly as claimed in claim 1, wherein said colored plate has a pair of transverse keyhole shaped slots, said light projecting caps being set in said slots for securing said caps in said plate.

9. The pixel display assembly as claimed in claim 1, further comprising bearing means on said panel arranged to support said gate during rotation.

10. The pixel display assembly as claimed in claim 1, wherein said gate is generally D-shaped and has an elongated pocket to lighten the mass of said gate.

* * * * *